United States Patent [19]

Ito

[11] Patent Number: 4,723,627

[45] Date of Patent: Feb. 9, 1988

[54] DOUBLE DECKED ELEVATOR CAR

[75] Inventor: Takuzo Ito, Oaza Takao, Japan

[73] Assignee: Mitsubishi Denki Kabushiki Kaisha, Japan

[21] Appl. No.: 826,871

[22] Filed: Feb. 6, 1986

[30] Foreign Application Priority Data

Feb. 12, 1985 [JP] Japan ..... 60-24712

[51] Int. Cl.[4] ..... B66B 9/00

[52] U.S. Cl. ..... 187/16; 52/30; 52/79.7

[58] Field of Search ..... 187/16, 1 R, 15, 62, 187/56; 52/30, 234, 236.3, 79.1, 79.7, 79.8, 220

[56] References Cited

U.S. PATENT DOCUMENTS 1,001,524 8/1911 Holcomb ..... 187/16

2,883,192 4/1959 Royston ..... 52/234

FOREIGN PATENT DOCUMENTS 53287 1/1967 Fed. Rep. of Germany ..... 52/236.3

2143217 2/1985 United Kingdom ..... 187/1 R

*Primary Examiner*—F. J. Bartuska

*Assistant Examiner*—Kenneth Noland

*Attorney, Agent, or Firm*—Leydig, Voit & Mayer

[57] ABSTRACT

A double decked elevator car comprises an upper car having an opening disposed adjacent a wall thereof, a lower car connected to the upper car and having an opening disposed adjacent a wall thereof, and a device for allowing passengers in the upper and lower cars to directly communicate with each other through the openings.

7 Claims, 7 Drawing Figures

DOUBLE DECKED ELEVATOR CAR

BACKGROUND OF THE INVENTION

The present invention relates to an elevator car structure having upper and lower cars vertically disposed in a double decked elevator.

In a conventional double decked elevator, as shown in FIGS. 1 and 2, a car structure comprises upper and lower cars 1 and 2 vertically separated from each other and supported by a rectangular frame 3. The frame 3 is hung from a main rope 4 at the center of an upper beam 5 of the frame 3 and is vertically moved by an unillustrated traction machine to guide the upper and lower cars 1 and 2 to the respective floors along unillustrated guide rails by respective rollers 6 disposed at each corner of the car frame 3. In an elevator of this type, passengers can be simultaneously conveyed by the upper and lower cars 1 and 2, in a condition in which the same horizontal space is required as in the conventional elevator. Accordingly, the number of passengers conveyed at any given time can be increased so that the number of elevators can be reduced.

However, since the upper car 1 is separated from the lower car 2, the passengers within the upper and lower cars 1 and 2 cannot directly communicate with each other. Furthermore, the times during which passengers enter and exit the upper and lower cars are not always in agreement with each other. Accordingly, when the door of either the upper or lower cars closes earlier than the door of the other car, the passengers in the one car must stand in a closed car waiting for the elevator to proceed, causing a certain anxiety brought on by an isolated feeling.

Further, even when it is not required by the passengers in one car to stop at a given floor, the one car must stop at that floor when passengers in the other car register a call for that floor. Therefore, in a conventional double decked elevator, an indicator is disposed within each car for communicating the calls to the passengers in the upper and lower cars, which however is insufficient to remove an anxiety arisen due to the passengers feeling isolated.

SUMMARY OF THE INVENTION

To overcome the conventional problems mentioned above, an object of the present invention is to provide a double decked elevator car in which passengers within the upper and lower cars can directly communicate with each other, so that no anxiety arises due to the passengers feeling isolated.

With the above object in view, the present invention resides in a double decked elevator car comprising an upper car having an opening disposed in a wall thereof, a lower car connected to a lower part of said upper car and having an opening disposed in a wall thereof, and means for allowing passengers in the upper and lower cars to directly communicate with each other through said openings.

BRIEF DESCRIPTION OF THE DRAWINGS

The present invention will be now described with reference to the preferred embodiments thereof in conjunction with the drawings in which.

DETAILED DESCRIPTION OF THE PREFERRED EMBODIMENTS

Figure 1:
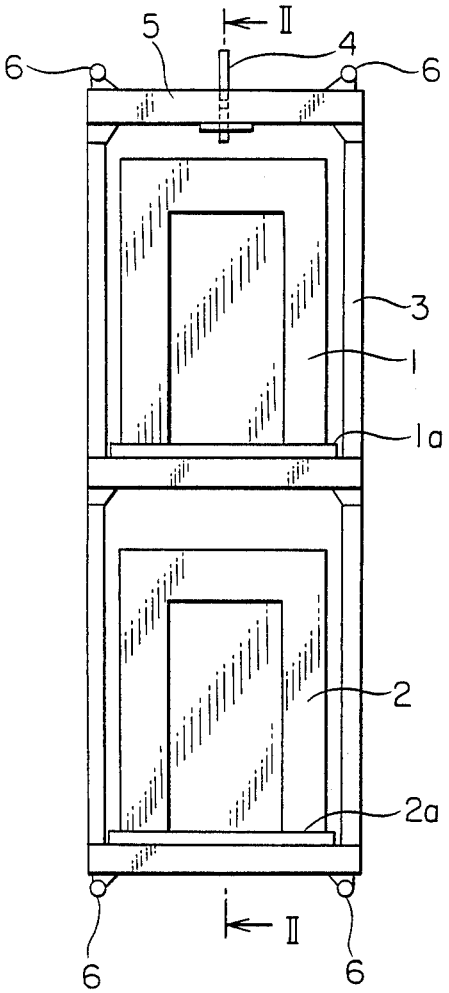
FIG. 1 PRIOR ART
FIG. 1 is a front view of a conventional double decked elevator car.
Figure 2:
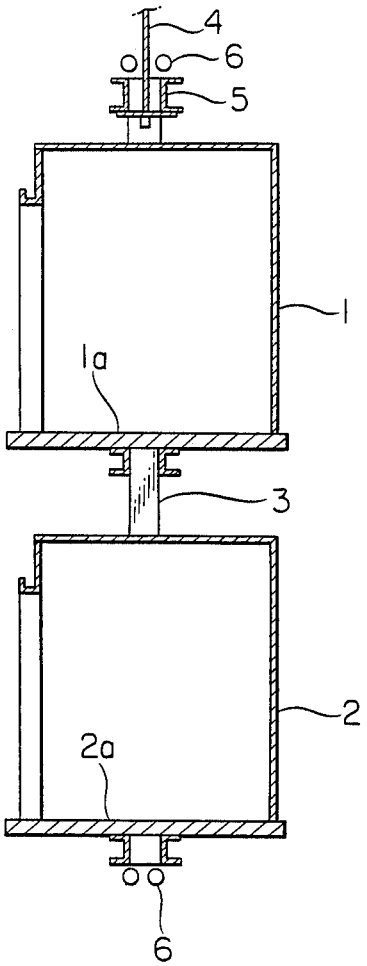
FIG. 2 PRIOR ART
FIG. 2 is a sectional side view taken on line II—II of FIG. 1.
Figure 3:
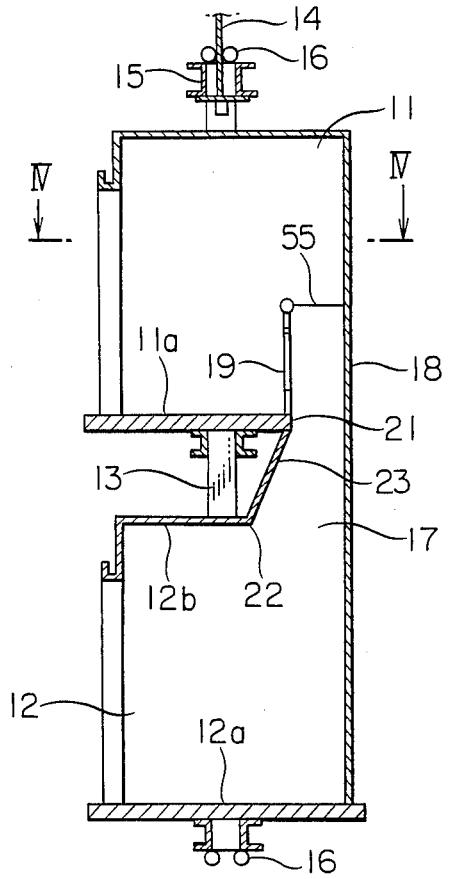
FIG. 3 is a longitudinal sectional side view of a double decked elevator car according to a first embodiment of the present invention.
Figure 4:
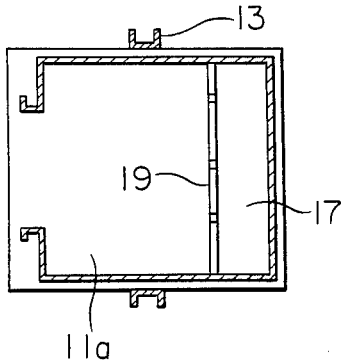
FIG. 4 is a horizontal sectional view taken on line IV—IV of FIG. 3.

Referring to FIGS. 3 and 4, a car structure in a double decked elevator according to the present invention comprises upper and lower cars 11 and 12, and a means for allowing passengers in the upper and lower cars 11 and 12 to directly communicate with each other. A rectangular car frame 13 for joining the upper car 11 with the lower car 12 is hung from a main rope 14 at the center of an upper beam 15 of the frame 13 and is vertically moved by an unillustrated traction machine to guide the upper and lower cars 11 and 12 to the respective floors along unillustrated guide rails by rollers 16 respectively disposed at each corner of the car frame 13.

The upper car 11 has an opening 21 disposed at the back portion of the floor 11*a* thereof, and the lower car 12 has an opening 22 disposed at the back portion of the ceiling 12*b* thereof. A communicating portion 17 for communicating the openings 21 and 22 with each other is defined by a connecting portion 23 and a common back wall 18 forming the back walls of the upper and lower cars 11 and 12. The communicating portion 17 is large in cross section enough for the passengers in the upper car 11 to directly look down into the interior of the lower car 12 through the communicating portion 17. The communicating portion 17 constitutes the means for allowing the passengers in the upper and lower cars 11 and 12 to directly communicate with each other through the openings 21 and 22 according to the present invention. The opening 21 of the floor 11*a* in the upper car 11 is bound by a handrail 19 vertically extending to prevent passengers within the upper car 11 from falling into the lower car 12 through the communicating portion 17. In the double decked elevator car of FIG. 3, the passenger capacity in the upper car 11 is less than that in the lower car 12.

According to the construction of the double decked elevator car mentioned above, the passengers within the upper and lower cars 11 and 12 can verbally communicate with each other through the communicating portion 17 at any time such as when certainn passengers want to know the situation within the upper or lower cars 11 and 12. Therefore, even when a door of one of the upper and lower cars 11 and 12 is closed while the other remains open, the passengers within the one car can wait for the door of the other car to close without the feeling of anxiety caused by a sense of isolation.

Figure 5:
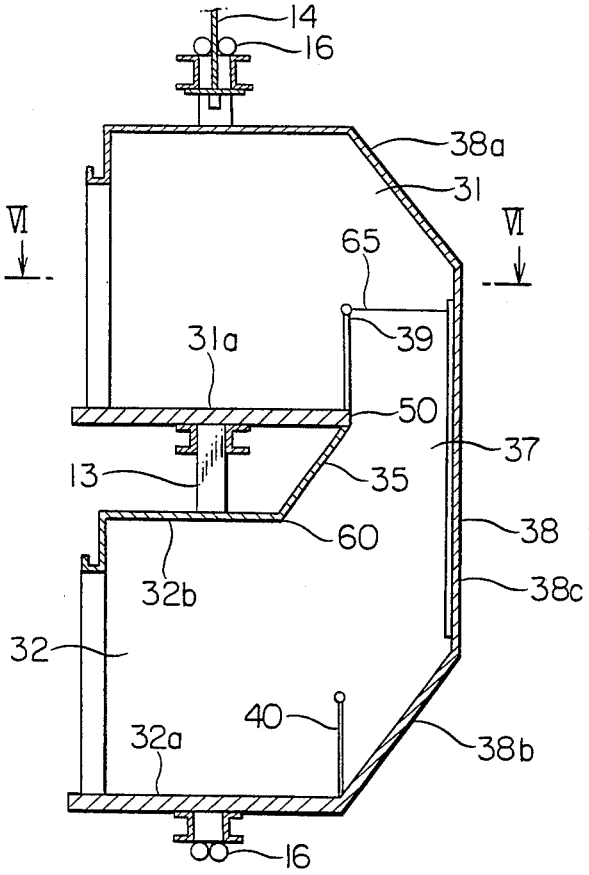
FIG. 5 is a longitudinal sectional side view of a double decked elevator car according to a second embodiment of the present invention.
Figure 6:
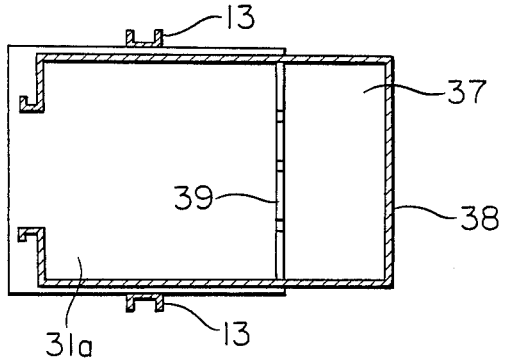
FIG. 6 is a horizontal sectional view taken on line VI—VI of FIG. 5.

FIGS. 5 and 6 show a second embodiment of the double decked elevator car according to the present invention. In this embodiment, a common back wall 38 for defining the back walls of upper and lower cars 31 and 32 has inclined portions 38*a* and 38*b* respectively connected to the ceiling of the upper car 31 and the floor 32*a* of the lower car 32, and an intermediate portion 38*c* for connecting the inclined portions 38*a* and 38*b* to each other. The common back wall 38 is formed backwards to the rear away from the back ends of the floors 31*a* and 32*a* so that the horizontal area of the floor 31*a* of the upper car 31 equals that of the floor 32*a* of the lower car 32, the passenger capacity in the upper and lower cars being equal to each other. A communicating portion 37 for allowing the passengers in the upper and lower cars to directly communicate with each other is defined by the common back wall 38 and a connecting portion 35 which connects an opening 50 defined by the floor 31*a* of the upper car 31 and the common back wall 38 to an opening 60 defined by the ceiling 32*b* of the lower car 32 and the common back wall 38. The communicating portion 37 is large enough in cross section for the passengers in the upper car 31 to directly look down into the interior of the lower car 32 through the communicting portion 37. The floors 31*a* and 32*a* of the upper and lower cars 31 and 32 are respectively bounded on one side by vertically extending handrails 39 and 40. It will be understood that effects similar to those in the first embodiment can be obtained by the construction of the second embodiment. Furthermore, in the second embodiment, the number of passengers received within the upper car is greater than that in the first embodiment, thereby improving the operating efficiency of the elevator car. The communicating portion 37 can be effectively utilized when paintings, advertisements or other display devices are disposed on the inner surface of the common back wall 38, or a viewing window is disposed in the common back wall 38.

Figure 7:
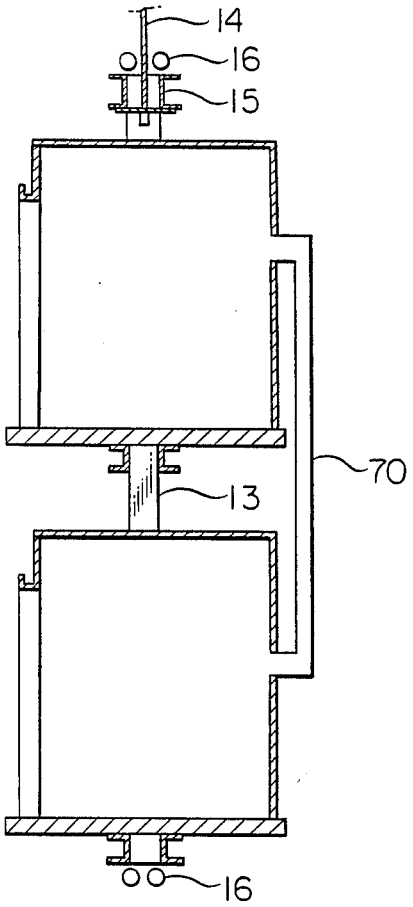
FIG. 7 is a sectional side view of a double decked elevator car according to a third embodiment of the present invention.

As shown in FIGS. 3 and 5, nets 55 and 65 for guarding the passengers in the upper and lower cars may be attached between the handrail in the upper car and the backwall thereof. Furthermore, as shown in FIG. 7, a hollow conduit 70 connecting an opening in the back or side wall of the upper car to an opening in the back or side wall of the lower car may be disposed instead of the communicating portion shown in FIGS. 3–6 to allow the passengers in the upper and lower cars to directly communicate with each other verbally. The communicating portions 17 and 37 and the hollow conduit 70 in the first, second and third embodiments are respectively useful for alleviating any anxiety felt by passengers in the upper and lower cars caused by a sense of isolation since sounds which may not be picked up by an indirect communicating device such as a microphone-speaker system within the upper and lower cars as well as the voices of the passengers are directly transmitted through the communicating portions of the hollow conduit.

What is claimed is:

1. A double decked elevator car comprising:

an upper car and a lower car beneath said upper car, each car having a means to vertically transport passengers and having a back wall and front wall opposing said back wall, said front walls lying in a common plane and said back walls lying in a common plane, the upper car having a door in the front wall and an opening disposed adjacent the back wall thereof;

the lower car having a door in the front wall and an opening disposed adjacent the back wall thereof; and means for allowing passengers in the upper and lower cars to hear each other through said openings.

2. A double decked elevator car as claimed in claim 1 wherein the back walls of the upper and lower cars are formed by a common back wall.

3. A double decked elevator car as claimed in claim 2 wherein said opening of the upper car is disposed in the floor thereof and said opening of the lower car is disposed in the ceiling thereof, each said opening being immediately adjacent to said common back wall.

4. A double decked elevator car as claimed in claim 3 wherein said communicating means has a cross section sufficiently large to allow the passengers in the upper car and lower car to see each other.

5. A double decked elevator car as claimed in claim 2 wherein the common back wall of the upper and lower cars is formed with an outwardly projecting portion spaced apart from the floor of said upper car and the ceiling of said lower car so as to constitute said communicating means.

6. A double deck elevator car comprising:

an upper car and a lower car beneath said upper car, said upper and lower cars having a common back wall and a front wall opposing the back wall, each car having a means to electrically transport passengers, the upper car having a door in said front wall and a floor with an opening disposed in the floor immediately adjacent said back wall, the lower car having a door in said front wall and a ceiling with an opening disposed in the ceiling immediately adjacent to said back wall, means for allowing passengers in the upper and lower cars to see and hear each other through said openings; and a guard member disposed on and extending upwardly from the floor of the upper car along a boundary of said opening in said upper floor opposite said back wall.

7. A double deck elevator car comprising:

an upper car and a lower car beneath said upper car, said upper and lower cars having a common back wall and an opposing front wall, each car having a means to vertically transport passengers, the upper car having a door in said front wall and a floor, the lower car having a door in said front wall and a ceiling;

the common back wall of said upper and lower cars formed with an outward projection so as to provide an opening between the common back wall and the floor of said upper car and the common back wall and the ceiling of said lower car; and guard members disposed on the floor of the upper and lower cars along a boundary of the openings of the upper and lower cars opposite said back wall.

* * * * *